US007506603B2

(12) United States Patent
Buzzi

(10) Patent No.: US 7,506,603 B2
(45) Date of Patent: Mar. 24, 2009

(54) UNSINKABLE HULL STRUCTURE AND A METHOD FOR THE MANUFACTURING THEREOF

(75) Inventor: Fabio Buzzi, Oggiono (IT)

(73) Assignee: FB Design S.r.l, Annone Brianza (IT)

( * ) Notice: Subject to any disclaimer, the term of this patent is extended or adjusted under 35 U.S.C. 154(b) by 0 days.

(21) Appl. No.: 11/821,527

(22) Filed: Jun. 22, 2007

(65) Prior Publication Data

US 2008/0035041 A1 Feb. 14, 2008

(30) Foreign Application Priority Data

Jun. 23, 2006 (IT) ..... PD2006A0259

(51) Int. Cl.
*B63B 5/24* (2006.01)

(52) U.S. Cl. ..... 114/357; 114/69

(58) Field of Classification Search ..... 114/357, 114/69, 360

See application file for complete search history.

(56) References Cited

U.S. PATENT DOCUMENTS 3,191,200 A * 6/1965 Fournillier ..... 114/357
3,315,284 A * 4/1967 Ludlow ..... 114/357
5,787,836 A * 8/1998 Blaisdell et al. ..... 114/357

* cited by examiner

*Primary Examiner*—Lars A Olson
(74) *Attorney, Agent, or Firm*—Abelman, Frayne & Schwab

(57) ABSTRACT

An unsinkable hull structure and a method for manufacturing an unsinkable hull structure, comprising a first bottom hull , a covering for the first bottom hull, a plurality of reinforcing structural elements arranged according to the longitudinal direction of the first bottom hull and the covering and made integral with both the bottom hull and the covering by connection; and filling for filling the volume defined between the first bottom hull and second covering and the plurality of longitudinal structural elements.

14 Claims, 7 Drawing Sheets

UNSINKABLE HULL STRUCTURE AND A METHOD FOR THE MANUFACTURING THEREOF

FIELD OF THE INVENTION

The present invention relates to a hull structure and, more precisely, to an unsinkable hull structure and to the related method for the manufacturing thereof.

STATE OF THE ART

In the boating field, specifically in yachting, the use of so-called unsinkable hulls is well-known. It is known that a boat sinks when it is no longer able to ensure a buoyancy at least equal to the weight on board and this may occur either in the case of a leak (collision) or when it is filled with water or, furthermore, in case of excess load.

To avoid sinking, the flooding of the boat must be avoided in the case of a leak, i.e. a hole or a break in the boat carina must be prevented from giving access to internal empty spaces, thus reducing the floating of the hull, and the reserve buoyancy of the hull must be guaranteed to be sufficient to support the maximum design load that a user should never overcome, plus that of the water that could flood the boat, for instance, in the case of a freak wave.

However, this case may not be avoided at all events, because not all breaches of the design conditions may be taken into account.

According to a known manufacturing method, there is provided that the buoyancy reserve required to make the hull unsinkable is obtained by filling all of the otherwise "empty" spaces in the cofferdam between the hull and the deck (which are not required for the filting of on board systems and facilities) with a foam having high density but low specific gravity. For instance, a manufacturing method for hulls of this kind is known as "Unibond® method" by the American boat builder Boston Whaler.

In these hulls, manufactured in fibre-reinforced plastic (FRP), the presence of the foam also prevents the boat from flooding in case a leak occurs, i.e. in case the shell of the hull breaks in the event of collision.

The hull and the deck are moulded according to techniques which may be traditional, but the moulds used for this process are reinforced with a steel structure that stiffens them so that the FRP mouldings may be perfectly and precisely coupled. The deck and the hull, which will be simultaneously ready, are firmly mounted one on the other in virtue of the reciprocal clamping of the moulds, for instance, by means of bolting.

At this point a liquid polymer, obtained by mixing according to predetermined ratios two different components, is injected in the cofferdam between the two shells, and, by reaction, expands giving rise to a closed cell polyurethane foam homogeneously filling all of the spaces and expelling all of the air. The foam not only fills, as mentioned, the empty spaces making the final hull unsinkable, but also serves as an adhesive between the hull and the deck. The boat thus obtained has a buoyancy reserve that may abundantly overcome the load limits provided for the boat, with clear advantages for the use safety. The foam also has secondary functions as sound absorbent material and it reduces vibrations.

However, this method displays some disadvantages which limit the field of use thereof. A first disadvantage is given by the fact that the method is practically applicable only for limited size hulls (indicatively up to a 10 m length), with propulsion guaranteed by outboard motors. In case the hull is intended for professional use, however, it could be required to install considerable powers, proportionally to size and weight, and the absence of a resistant internal structure defines the limits for such a construction.

Another disadvantage is given by the fact of not displaying an internal reinforcement structure consisting of transversal and longitudinal elements, this rendering the foamed hull definitely less resistant to stress as compared to an identical non-foamed hull, manufactured with an internal structure made of a sandwich of marine grade plywood, according to already known methods. This implies a poor aptitude to tolerate twisting and flexing loads acting on the hull, as the size increases.

SUMMARY

It is the object of the present invention to solve the above-listed disadvantages, by providing a manufacturing method to manufacture an unsinkable hull that combines the advantages of the foamed boat ("macro-sandwich" structure and unsinkability) and the advantages of the structured boat (greater resistance).

It is another object of the present invention to provide a manufacturing method to manufacture an unsinkable hull which is suitable for use on hulls having larger size and higher installed powers as compared to those in the state of the art (specifically with on board motors and surface transmissions).

It is a further object of the present invention to provide a manufacturing method to manufacture an unsinkable hull allowing to significantly reduce the manufacturing times as compared to the manufacturing method for hulls with a sandwich laminated structure (even 50%) and that, at the same time, allows to make a FRP artefact that requires no finishing and minimum maintenance.

Therefore, the present invention provides a manufacturing method to manufacture an unsinkable hull and a related unsinkable hull according to the accompanying claims.

A first advantage of the method of the present invention resides in the fact that the hull thus manufactured displays an extremely simplified bilge discharge system for the boat with respect to a non-foamed traditional hull.

Another advantage of the present invention is given by the fact that it displays a high rationalisation of the set of moulds required to manufacture the hull with the possibility of reducing the coupling tolerances between the various moulded parts.

BRIEF DESCRIPTION OF THE DRAWINGS

There is now provided a detailed description of a preferred embodiment of the manufacturing method for the manufacturing of an unsinkable hull and a related unsinkable hull thus manufactured, according to the present invention, given by mere way of non-limitative example, by referring to the accompanying drawings, in which.

DETAILED DESCRIPTION OF THE INVENTION

Figure 1:
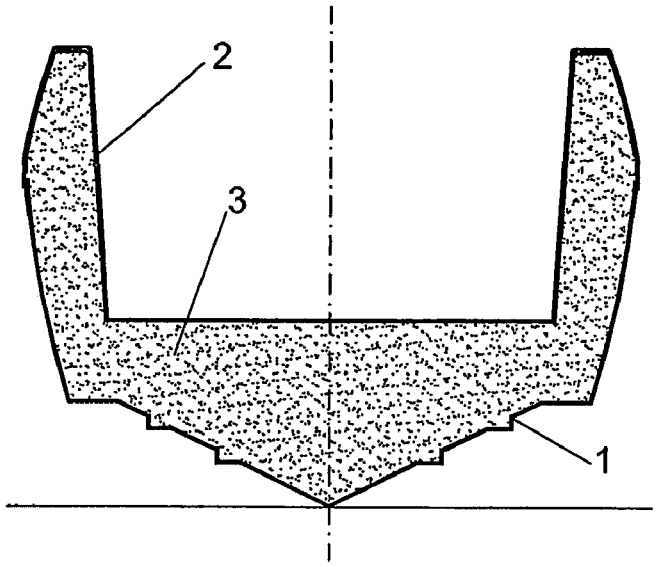
FIG. 1 schematically shows the section of an unsinkable hull obtained according to the method of the state of the art.
Figure 2:
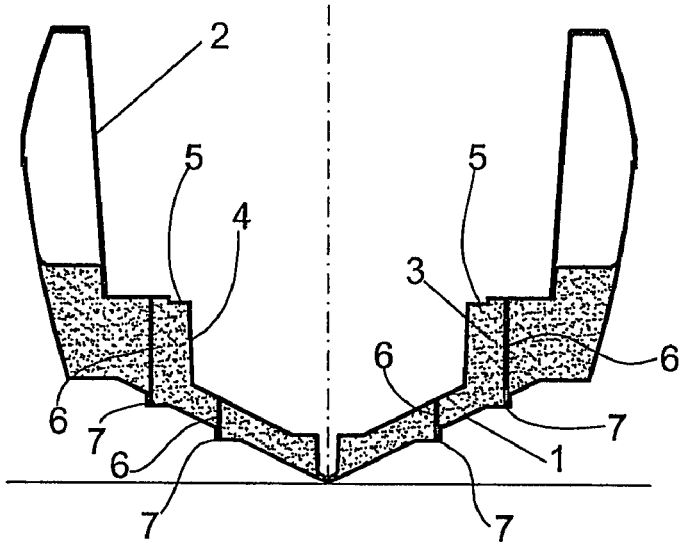
FIG. 2 schematically shows the section of an unsinkable hull obtained according to the method of the present invention.

With reference now to FIGS. 1 and 2, on the basis of the observation that the maximum operative displacement of a hull is a design datum, the volume of the hull to be destined to a buoyancy reserve may therefore be established from the beginning in virtue of the foam injection and be obtained during design. The value obtained as a result of the simple calculation of the weights may be increased by using a safety coefficient considered valid by the builder or, more often, fixed by the rules in force or by the regulations of the user bodies.

FIG. 1 shows a section of a boat that displays an unsinkable hull obtained by means of the method of the state of the art (for instance, the Unibond™ system by Boston Whaler).

According to this known method, there is provided the moulding of a hull 1 made of a material which is typically employed for this kind of boats, such as reinforced resinous material such as, for instance, FRP or the like. Furthermore, a deck 2 is provided that is also moulded according to traditional techniques and adapted to subsequently be precisely mounted on the hull 1.

Then, a liquid polymer, which expands by chemical reaction giving rise to a foam 3 (for instance, a closed cell polyurethane foam) which homogeneously fills all of the spaces and expels the air, is injected between the two "shells". In this manner, the hull is completely filled by the foam 3 which not only fills, as mentioned, the empty spaces thus making the final hull unsinkable, but also acts as adhesive between the hull and the deck.

In this manner, a boat is obtained with a buoyancy reserve that often abundantly overcomes the load limits provided for the boat.

FIG. 2 shows a section of an unsinkable boat obtained by means of the method of the present invention. For the sake of illustrative clarity, the same parts will have the same numerals.

It immediately appears clear that according to the method of the present invention, the filling of the whole space between the hull 1 and the deck 2 is not provided, but rather only the filling of the lower part of the boat except for the side walls. This part, destined for the filling by means of foaming, is completely delimited by the FPR moulding that serves as the floor of the cockpit 4 (except for the access hatches to the stowage compartments) and interior of the forecabin. Hereinafter this element will be simply designated as the floor of the cockpit.

Unlike the most widespread traditional constructions, in this case the deck 2 does not serve as treading plane and is fixed to the mouldings at numerals 1 and 4 only in a manufacturing step that follows their combination by means of adhesion and foaming, as set forth hereinafter.

The rationalisation of the volume to be destined for the buoyancy reserve, for unsinkability purposes, allows to create and exploit compartments below the treading plane of the floor of the cockpit 4 itself, for general stowage purposes or, for instance, in order to install the fuel boxes and the freshwater tank (not shown in the figure). These compartments appear in the form of tanks (the bottom of which mimics the shape of the carina of the hull 1 at that level) which are only open on the upper side, so as to be closed by means of a removable hatch. Therefore, the moulding of the deck 2 does not provide the bottom of the floor of the cockpit 4, that was instead incorporated therewith in the case designated as the state of the art, and, as shown in FIG. 1, maintains only the internal and external side walls of the deck 2.

Furthermore, according to the present invention there is provided that a plurality of longitudinal structural elements 6 is arranged within the two shells consisting of the hull 1 and the floor of the cockpit 4 in the intrinsically already known manner, said structural elements being adapted to form the reinforcement structure required to give the boat a structural resistance suitable for the loads to tolerate.

The function of the longitudinal elements 6 is well known as it is already widely applied to the traditional type of boats. Indeed, from structural engineering it is known that, being the shape of a generic section the same, the resistance of the section itself may be increased by introducing sectors and increasing the number of the closed cells in which such a section may be subdivided.

Therefore, according to the present invention a multiple closed cell unsinkable boat structure may be obtained, each closed cell being delimited by the longitudinal vertical elements 6 which connect the bottom 1 of the boat with the internal plane of the floor of the cockpit 4.

Indeed, as may be noted in the figure, in the case of a planing hull 1 having a "V"-shaped carina and provided with one or more transversal notches and longitudinal guide blocks 7 for each of the two sides of the "V", it is clear that it is possible to exploit the presence of these longitudinal "guide blocks" 7 to position the longitudinal reinforcing elements 6 within the hull 1 (the whole matter is better depicted hereinafter). Actually it is well known that not all hulls are provided with longitudinal guide blocks and that, in any case, the extension thereof does not reach the transom. In similar situations positioning templates are adopted.

Figure 3:
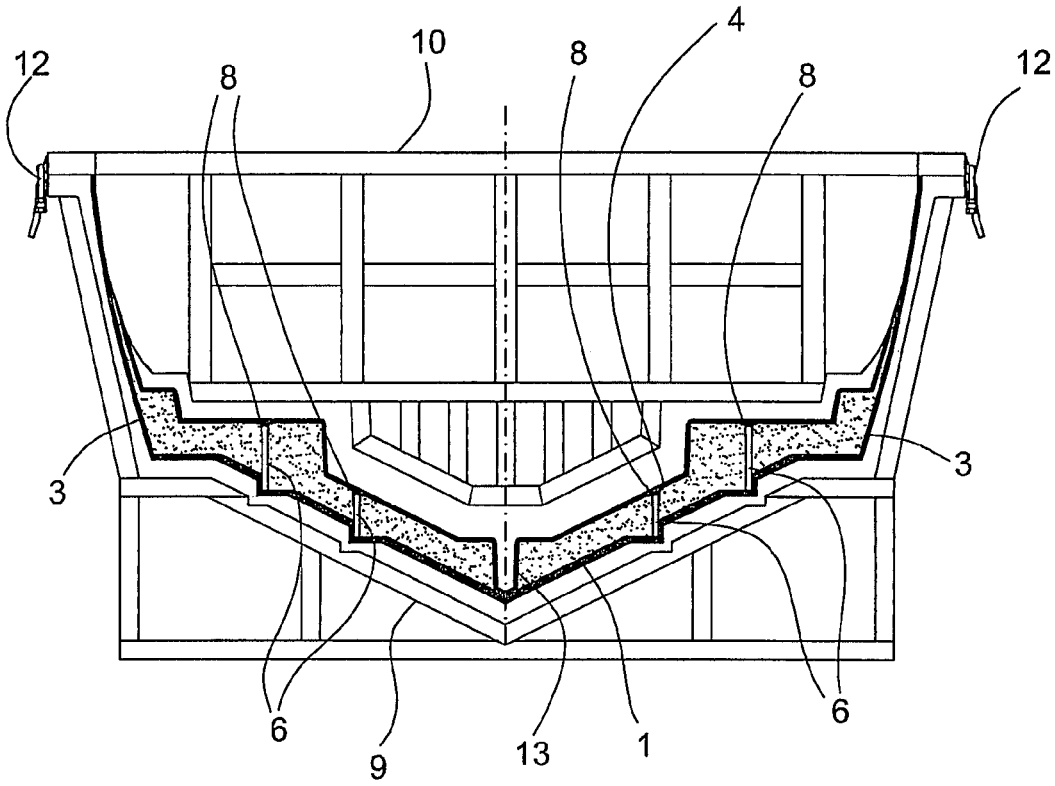
FIG. 3 schematically shows the arrangement of the moulds during the moulding step of the unsinkable hull, according to the method of the present invention.

FIG. 3 schematically shows a partial section of the arrangement of the moulds to manufacture the unsinkable boat according to the method of the present invention.

More precisely, according to the method of the present invention, there is provided the manufacturing of a so-called "macro-sandwich" structure with which both the hull 1 and the floor of the cockpit 4 are manufactured by means of a simple FPR laminate, contrarily to the "micro-sandwich" structures of the state of the art (and except for the part that will form the engine-room as already described above). Indeed, according to the manufacturing method of the present invention, there are provided longitudinal elements 6, which are made integral with the hull 1 and the related floor of the cockpit 4 by means of structural adhesives (unlike the state of the art, where the former are welded to the hull 1 and to the deck 2 by means of bands of plastic reinforced by fibreglass, in virtue of the possibility for direct access).

Furthermore, the deck 2 is joined to the group consisting of the hull 1 with the floor of the cockpit 4 only after the filling by means of the foam 3. Once directly adhered to the hull 1 by means of structural adhesives, the longitudinal elements 6 are then adhered, again with structural adhesives, to the floor of the cockpit 4 by guiding means consisting of a profiled element 8 which is integral with the same longitudinal element 6 and better described hereinafter.

This kind of solution, as well as other advantages, displays the enormous advantage of not needing to provide, during the step of manufacturing the boat, accesses from the outside for the welding of the longitudinal elements 6 to the floor of the cockpit 4. Furthermore, according to the structure of the present invention the polyurethane foam 3 serves as a core for the "macro-sandwich", a function that in the case of the "micro-sandwich" structures of the state of the art is carried out by balsa wood sheets or marine grade plywood.

In order to carry out the method of the present invention, the bottom hull 1 is firstly manufactured as a simple laminate made of FPR-type material on an appropriate mould 9. Therefore, the floor of the cockpit 4 is simultaneously manufactured by means of a similar moulding procedure and a corresponding mould 10.

Therefore, the longitudinal elements 6 are adhered to the bottom 1 by means of a structural adhesive. It should be noted here that in a non preferred alternative embodiment, the longitudinal element 6 may be welded to the bottom by using the traditional method, as this operation takes place before the closing of the moulds, when there is total and perfect access to each part of the boat.

Then, for the adhesion of the longitudinal elements 6 on the internal face of the floor of the cockpit 4, there is provided the use of supporting and locking means consisting of a series of profiled elements 8 which are mounted by means of structural adhesives at first on the free edges of each longitudinal element 6 and then, once the upper mould is closed, rest on the internal face of the floor of the cockpit 4 thus providing the support adhered to the latter (better shown hereinafter).

Therefore, once the profiled elements 8 are arranged on each longitudinal element by means of a structural adhesive, the structural adhesive is deposited on the internal surfaces of the floor of the cockpit which will adhere to the internal surface of the bottom, so as to guarantee the sealing of the cells or chambers to be foamed. At this point the moulds 9 and 10 are closed one on the other and are preferably locked by means of a determined number of lever-type closures 12, arranged along the whole coupling periphery of the moulds 9 and 10, in an intrinsically already known manner. According to an alternative method, matched moulds provided with plates and bolts may be used.

The procedure continues with the foaming of each single compartment delimited by at least one longitudinal element 6 (a six-compartment hull 1 is shown in the figures), according to the already known techniques. This operation is preferably carried out for all of the chambers at the same time, by using suitable equipment. The contemporaneity virtually avoids all risks of deformation of the longitudinal elements 6, which could arise in case of expansion of the foam in a compartment having adjacent empty chambers.

Once the foam 3 hardens and dries (i.e. after a certain number of hours), the group of moulds can be opened, the mould 10 of the floor of the cockpit 4 (which may also be defined as "matched-moulding" of the bottom) can be released, the completely foamed group consisting of the hull 1 and the floor of the cockpit 4 can be extracted, thus releasing the mould 9 of the bottom.

All of the moulds are ready to start the production cycle again.

A further fixing of the floor of the cockpit 4 to the bottom 1 is obtained by using bands of plastic reinforced by fibreglass having bidirectional fibres, applied along the junction contour between the two, from the outside.

According to an advantageous aspect of the method of the present invention, a longitudinal central element 13, also directly obtained by moulding, may also be made on the floor of the cockpit 4, at the keel of the hull 1, such a longitudinal element 13 replacing an equivalent similar element made of marine grade plywood for a traditional structure. The moulded keel longitudinal element 13 is obtained by means of a film of FPR, as the floor of the cockpit 4 it is part of and, after having combined the segments thereof with resined tubes, may be exploited also as main bilge pipe for the boat. The subdivision in segments, which has been mentioned just above, is simply explained by recalling the presence of the stowage compartments (for tanks and generic stowage), which are separate from one another.

According to another advantageous aspect of the present invention, the tolerance required at the time of the coupling of the moulds 9 and 10 is simply in a vertical direction, and is guaranteed by the size and arrangement of the profiled elements 8, whereas there are no strict requirements for the transversal and longitudinal tolerance.

Therefore, a direct consequence is the simplification of the whole production process, which becomes fast and may easily and completely be made standard. Indeed, in addition to the normal controls on the lamination (having established the lamination sheet, the weight and the thicknesses of the artefact are kept under control through the amount of resin employed), a positioning template will be necessary and sufficient for the longitudinal elements 6, which may preferably be cut with numerical control machines, whereas the profiled elements 8 may be made by extrusion.

According to a further advantageous aspect of the present invention, a resistant structure hull having multiple closed cells, defined by the presence of at least one of the longitudinal elements 6, may be obtained.

Figure 4:
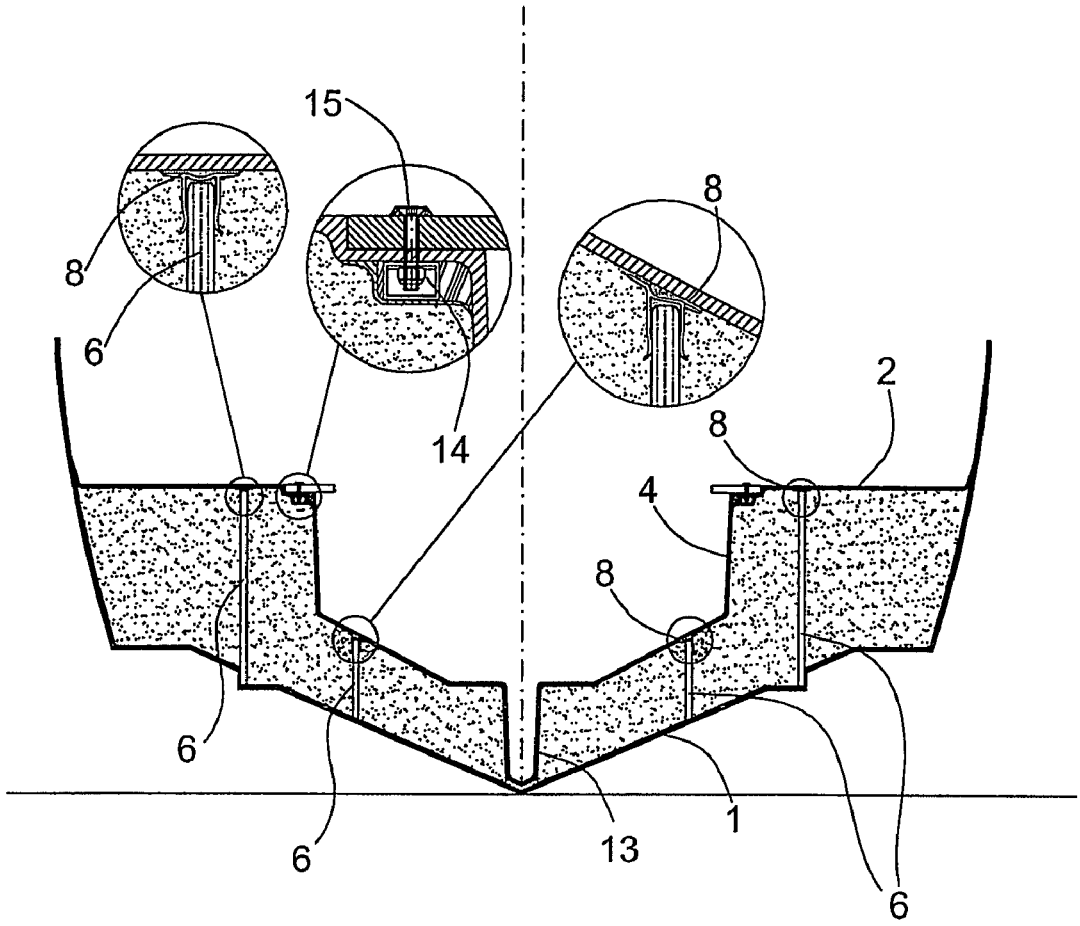
FIG. 4 shows a section and some details of an unsinkable hull obtained according to the method of the present invention.
Figure 5A:
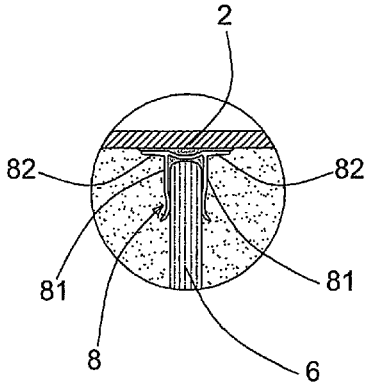
FIGS. 5A, 5B, 5C show details of the hull in FIG. 4.
Figure 5B:
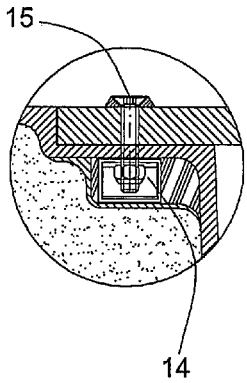
Figure 5C:
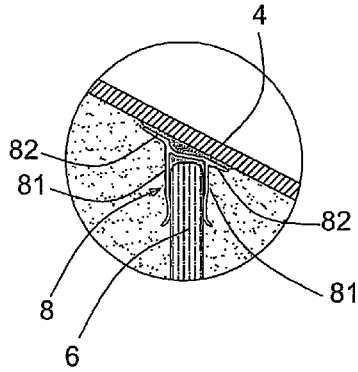
Figure 6:
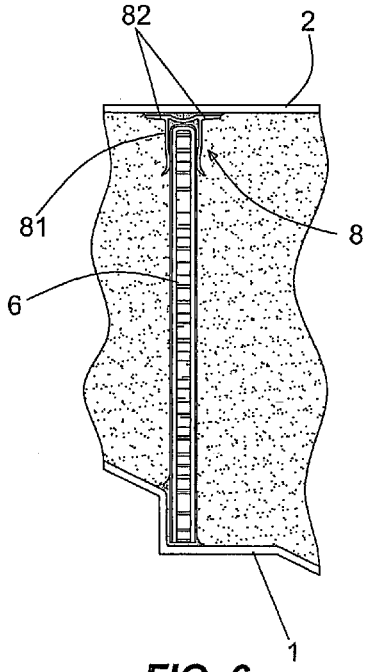
FIG. 6 is a partial view of a part of the hull in FIG. 4.

FIGS. 4 to 6 show a partial and cross-section view of an unsinkable hull for a boat obtained by the method of the present invention. For the sake of illustrative clarity identical parts have identical numbers.

According to the present invention, the hull 1 displays a moulding of the floor of the cockpit 4 which is manufactured such that it is also suitable for the application of on board motors and all kinds of transmissions that may be applied to them. More precisely, according to the present invention there is provided that the part of stern of the hull 1 (destined for the engine-room), is manufactured by means of a "micro-sandwich"-type structure, i.e. external fibreglass films with a core formed by sheets of marine grade plywood, balsa wood or the like, and a conventional structure, as the fitting of this kind of motors requires resistant foundations of the traditional type, which are different, as far as the shape thereof is concerned, for any type of motor.

Here it is clear for those skilled in the art that the joint between the two parts of the stern (i.e. that delimited by the moulding of the cockpit 4, in which the foam 3 resides, and that in which it is absent) represents the most critical area from the structural point of view. More precisely, by analysing the boat manufactured according to the present invention and following a direction from stern to head, it is clear that the boat initially consists of a "micro-sandwich" structure and then becomes, through a discontinuity, a structure of the "macro-sandwich" type, as previously described. Therefore, there will be concentrated loads at the discontinuity, with subsequent major risks of breaking.

In order to eliminate this discontinuity, it is possible to act on the recovery of the continuity of the longitudinal elements, as explained in detail hereinafter, but it is also used the possibility of not terminating the laminated part according to the "micro-sandwich" technique exactly where the joint between the hull 1 and the moulding of the floor of the cockpit 4 is placed, but instead of extending it below the foamed part. Such an area will be further reinforced with unidirectional bands of Kevlar® laminated in a longitudinal direction (for instance having a length of 500-750 mm for a 10-12 m hull)

having the center line thereof at the separation surface between engine-room and foamed part.

For instance, according to the present invention, for a 10-12 m long hull there is provided that the laminated part according to the "micro-sandwich" technique, which is left protruding for the following joint, is indicatively 100-200 mm long, whereas the length of the unidirectional reinforcing bands of Kevlar® for such a protruding part to be laminated in a longitudinal direction will be 500-750 mm.

With reference now to FIGS. 5A, 5C and 6, a detailed description of the step of adhering the longitudinal element 6 to the bottom 1 and to the floor of the cockpit 4 will be provided.

The longitudinal reinforcing elements 6 may be made of plywood for marine applications, coated with fibreglass and welded to the hull 1, by means of the use of positioning templates to make the operation precise and fast. For this purpose, the longitudinal elements 6 are made integral with the hull 1 and with the floor of the cockpit 4 by means of structural adhesives (whereas in the traditional manufacturing technique, these are welded to the hull 1 and to the deck 2 with fibreglass bands).

Furthermore, as far as the profiled element 8 which is fundamental for the fixing of the deck on the longitudinal elements 6 is concerned, the use of an extruded aluminium shape (or pultruded fibreglass shape) with a preferably "π" shape can be provided.

This extruded element 8 has the following features:

the minimum free section comprised between the two vertical legs 81 of the "π" element is a few tenths of a millimeter shorter as compared to the thickness of the longitudinal element 6 coated with fibreglass, in order to obtain a better adhesion and ensure the sealing of the structural adhesive chamber;

the two vertical legs 81 open swallow-tailed towards their free end, so as to facilitate the positioning and ensure a spring effect;

the length of the two vertical legs 81 is such as to guarantee the formation of a chamber between the extruded element 8 and the upper part of the longitudinal element 6, capable of containing an amount of structural adhesive sufficient for the adhesion of the profile 8 to the longitudinal element 6;

the length and the width of the horizontal side profiles 82 (or tilted according to the coupling surface) are such as to guarantee an adequate adhesion surface by contact with the lower face of the floor of the cockpit 4 when the moulds are closed one on the other;

the upper plane of the "π" profile 8 displays a series of bores orthogonally to the plane (not shown in the figures), with a certain spacing, in order to allow the escape of possible excess structural adhesive contained in the chamber previously described, when the moulds are closed.

Each "π" profile 8 is forced on the corresponding longitudinal element 6, for instance by using rubber-headed hammers, and then the structural adhesive is injected in the chamber formed between the profile 8 and the longitudinal element 6, through the above-described bores.

Furthermore, preferably, but not necessarily, to avoid there being a height positioning error of the profile 8 (and i.e., in order to ensure the adhesion on the surface of the floor of the cockpit 4), nails are driven on the edge and with a certain spacing range into the longitudinal element 6, so as to avoid that the profile 8 descends on the longitudinal element 6 as an effect of its own weight or in case the longitudinal element 6 has a maximum thickness lower than the minimum opening of the legs 81 of the "π" profile 8.

When the moulds 9 and 10 are closed, the nails will be driven for a certain height in the longitudinal element 6.

Finally, the whole is joined by adhesive when the moulds are closed to then perform the following steps of foaming and extraction of the hull as previously described.

FIG. 4 shows the end result, i.e. the bottom-interiors complex extracted from the moulds: the sides of the boat or hull do not appear because they are part of the moulding of the deck 2 that is fixed in a following step and the volumes included therein do not contribute to floating.

Figure 7:
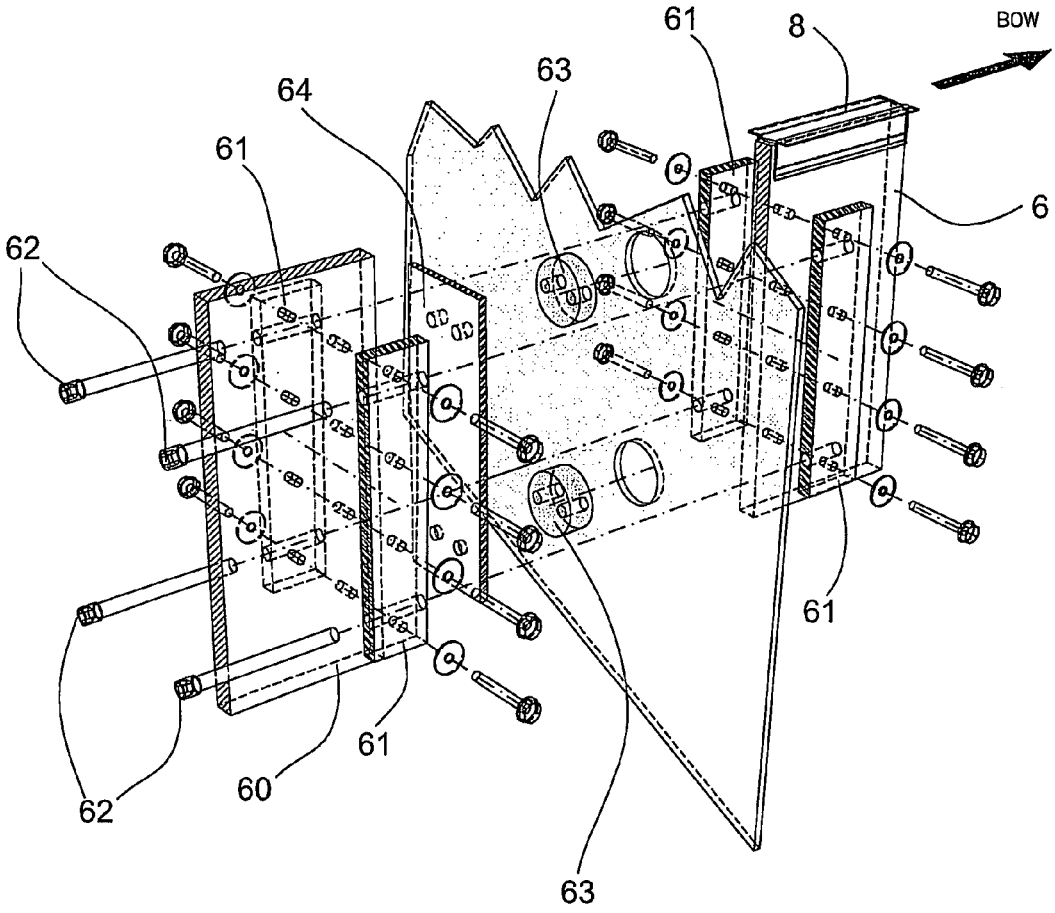
FIG. 7 is a partial view of a part of the unsinkable hull obtained with the method of the present invention.
Figure 8:
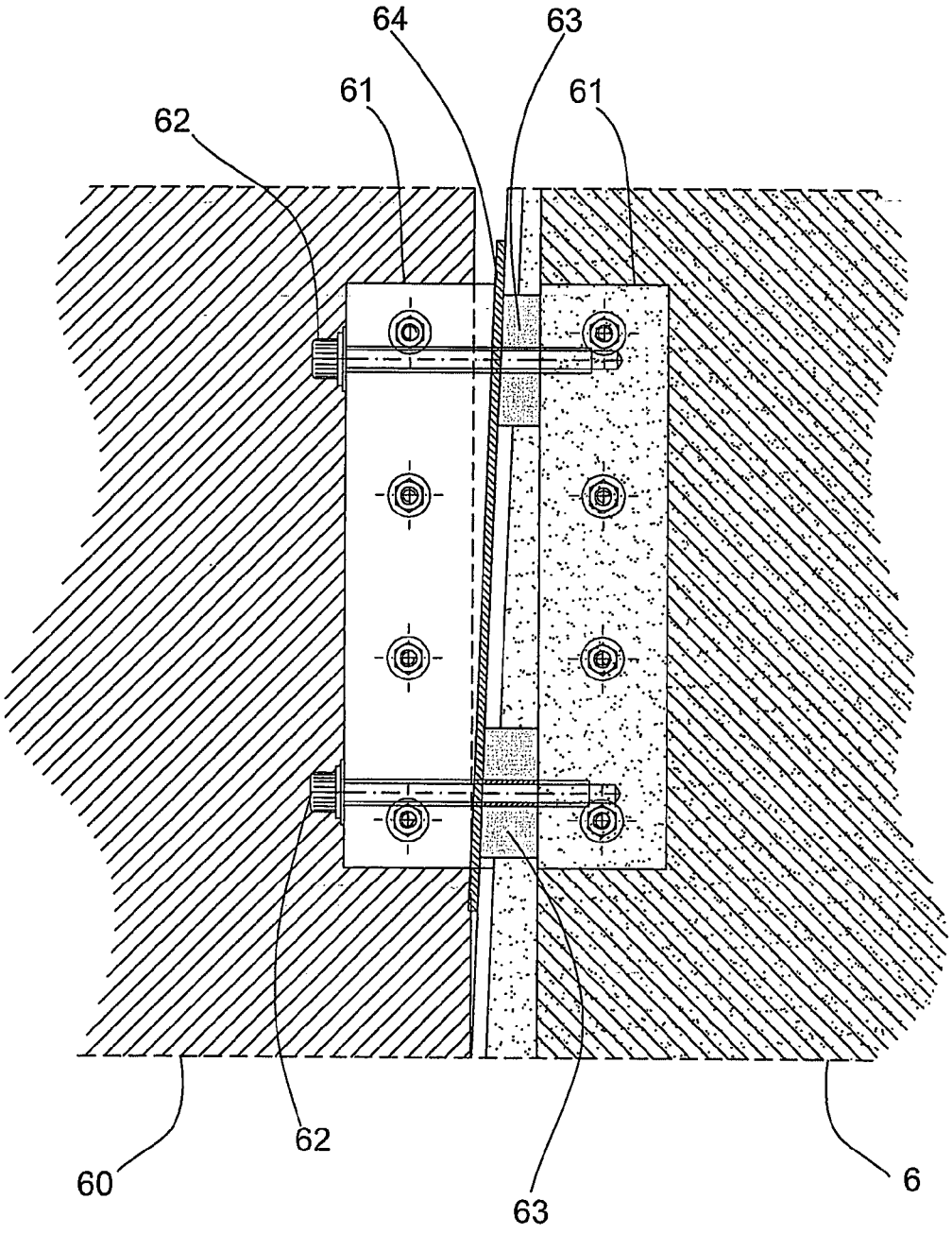
FIG. 8 is a top side view of the part of the hull in FIG. 7.

With reference now to FIGS. 7 and 8, a structural part of the hull is shown where the recovery of the continuity of the longitudinal elements 6 between the engine-room and the foamed part of the hull is indicated.

The recovery of the longitudinal elements 6 is required to increase the longitudinal stiffness (flexion loads) of the boat. It must be noted that it will be possible to recover the continuity only of the external longitudinal elements 6, whereas the internal elements will terminate at forward of the separation surface, or bulkhead, being too low to form a structure in the engine-room.

For this purpose, after having installed the longitudinal elements 6 in the hull with the positioners dedicated for this purpose, two metal plates 61 (preferably made of aluminium or steel), with boring perpendicular to the faces (for instance four holes) for the fixing of the plates to the longitudinal element 6, are attached by means of structural adhesives and are bolted on the opposite faces of the longitudinal element 6 involved. Each of the two plates 61 will have two threaded holes, facing towards the interface surface between the foamed part and the engine-room, and arranged according to the same developing direction of the longitudinal element 6 involved, for the engagement of respective bolts 62 which recover the continuity.

Having carried out the foaming and having opened the moulds, the surface separating the foamed part from the engine-room is locally perforated by using a cupped cutter, to uncover the fixing threaded holes. This operation is made easier by the use of appropriate markers, obtained directly by moulding, which indicate the exact boring position. The removed material (fibreglass moulding and small amount of foam) is replaced by an aluminium disc 63 having the same thickness and perforated so as to couple with the corresponding threaded holes.

In order to avoid the foam from filling the holes, they may be previously sealed by using grains, which will be removed at this point.

In this condition, the respective longitudinal elements 60 of the engine room may be installed. On the end thereof, at the separation surface between the foamed part and the engine-room, two plates 61 are fixed which are similar to the first ones (similarly joined by adhesive and/or bolted to the longitudinal element 60) but with longitudinal non-threaded through holes adapted to house the corresponding screws 62. Furthermore, to better distribute the load on the screws 62 which recover the continuity of the longitudinal element 6, it may be provided the use of a further thin aluminium plate 64 as an interface between the head of the screws and the related plate 61.

As it appears clear, the constructive configuration described up until now displays the advantage of reducing the construction times as well as the possibility of strengthening the structure.

Figure 9A:
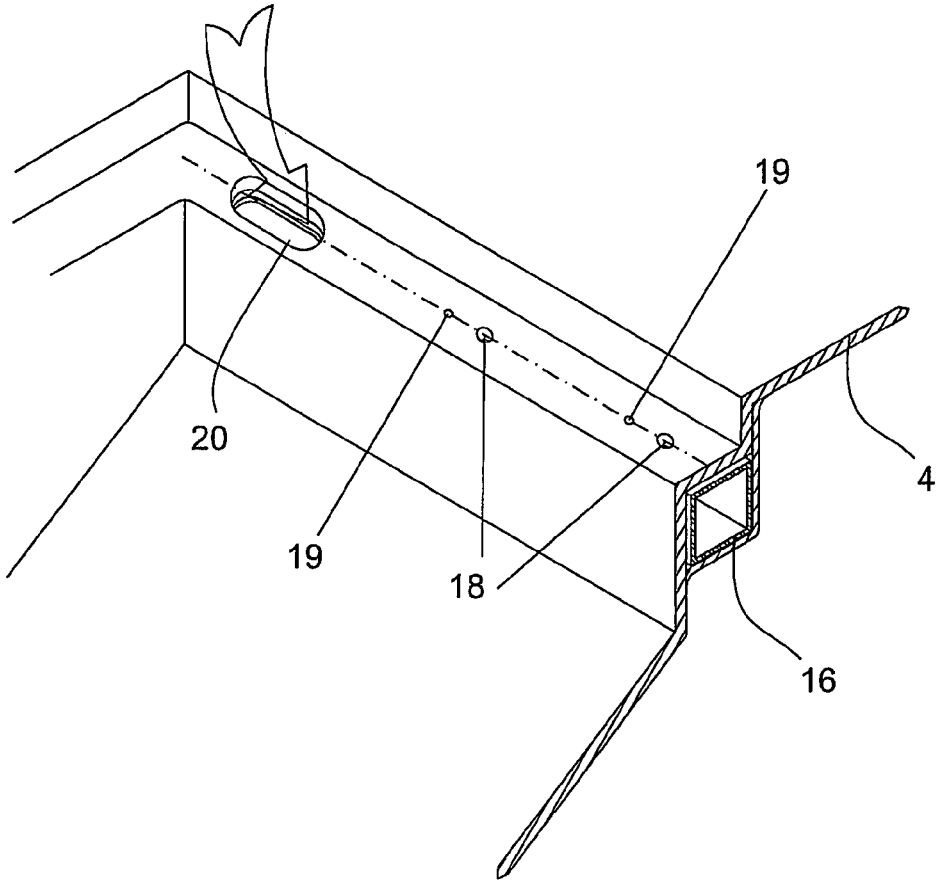
FIG. 9A is a partial and perspective view which shows a part related to a cockpit of an unsinkable hull obtained according to the method of the present invention.
Figure 9B:
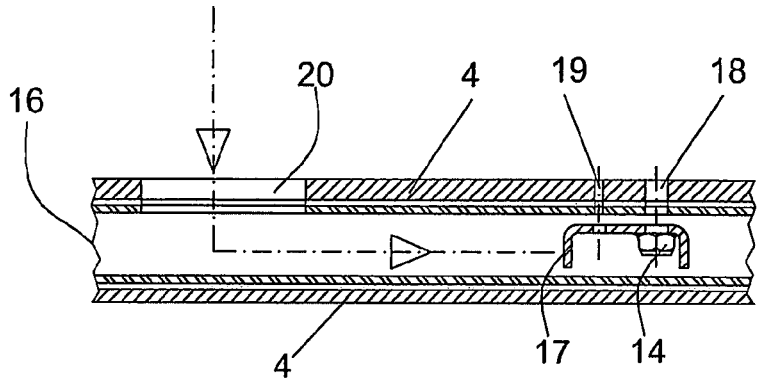
FIG. 9B is a partial and detailed section view of a part of the hull in FIG. 9A.

FIGS. 5B, 9A and 9B show the fixing system for the bottom boards which close the peaks obtained by moulding in the floor of the cockpit 4.

It must be noted here that the foamed hulls in general, must not in particular be perforated to avoid impairing the impermeability of the foamed closed cells. Indeed, in traditional boats, the accessibility of the internal spaces is usually exploited for the closing of the peaks and the fixing of the bottom boards, this accessibility not existing for the boat of the present invention and therefore a different solution being needed.

According to the method of the present invention, there is provided the use of threaded bushes 14 which are rivetted or screwed to the fibreglass moulding on the internal side to engage respective screws 15 passing through the thickness of the bottom board and for locking the related closing hatch of the cockpit 4. In this manner, this fixing system may be inserted directly in the moulding, thus creating a tight chamber dedicated to this purpose.

More precisely, before carrying out the operations described in the previous section, an aluminium profile 16 is laminated at the frames of the peaks on the moulding of the floor of the cockpit 4, the profile 16 having a closed square or rectangular section of predetermined size. The lamination technique may provide the use of structural adhesives to obtain a better adhesion and a better resistance.

This hollow profile 16 acts as a guide for the introduction and the passage of inserts 17 which include traditional threaded bushes 14.

While the lamination of the aluminium profile in the floor of the cockpit 4 is carried out before the foaming, the operations described hereinafter are preferably carried out in a period of time that follows the foaming itself and the removal of the artefact from the moulds.

The installation of the bottom board requires a determined number of fixing holes 18, arranged along the periphery of the first at predetermined distances. The holes 18 must be repeated in an identical position on the fixing frame which is part of the moulding of the floor. In order to repeat the series of holes 18 on both of the objects the bottom board itself may be used as a template, by using references 19 and perforating the moulded frame and the upper face of the aluminium insert 16, or the same boring mask may be used for both at a predetermined distance from each hole 18 for the passage of the screws. The use of the boring mask allows to make the holes 18 on the frame without having to change the equipment.

For each side of the frame, the end holes are milled to obtain a notch 20 having a size such as to allow the passage of the inverted "U"-inserts 17, made of stainless steel with the fixing nut 14 welded and centring hole. These inserts are made of steel to allow the welding of the nut 14.

One at a time, the inserts 17 are inserted in the profile 16 through the previously milled notch 20 and pushed with a flexible metal cable, of the Bowden-type, until the holes thereof correspond to those previously made with the templates. A self-tapping screw is screwed in the hole 19 having smaller diameter on the frame, so as to insert itself in the corresponding hole of the underlying insert 17, which will have a larger diameter. Indeed, this screw has centring functions and prevents the sliding of the insert 17 in case an already installed bottom board has to be removed, but it does not lock it rigidly.

This series of operations is repeated for all of the bottom boards and for all of the fixing holes; at the end, the bottom board may be installed. There are preferably used stainless steel screws having a countersunk head and hexagonal socket, with an underscrew made of stainless steel or, preferably, plastic material, which rests on the bottom board, so as to distribute the fixing load on a greater surface. Alternatively, the hole in the bottom board may be flared in order to have the head of the screw flush and not protruding.

The best water seal of the bottom board will be obtained by using the traditional siliconising techniques for the frames and the holes in combination.

The invention claimed is:

1. A method for manufacturing an unsinkable hull structure, comprising the following steps:

arranging a bottom hull (1) on a first mold (9), and a similar covering (4) for said hull (1) on a second mold (10);

arranging and fixing a plurality of longitudinal structural elements (6) on said bottom hull (1) and in the longitudinal direction of said hull (1);

arranging and fixing a plurality of support and locking means (8) on free edges of each longitudinal structural element (6) by means of structural adhesives;

arranging structural adhesive on an external surface of said plurality of support and locking means (8) by providing a respective plurality of support and connection surfaces for an internal surface of said second covering (4) on said hull (1);

closing and locking said molds (9,10) in position one on the other by means of locking means (12);

carrying out an injection of a foaming material (3) in a space defined between said bottom hull (1) and said covering (4) and in each single compartment delimited by at least one longitudinal structural element (6) between said bottom hull (1) and said covering (4); and following the drying and hardening of said foaming material (3), releasing the group of the moulds (9,10) and extracting the group formed by hull (1) and covering (4).

2. The method for manufacturing an unsinkable hull structure according to claim 1, wherein a use of templates or masks for an exact positioning of said plurality of longitudinal structural elements (6) on said bottom hull (1) is provided.

3. The method for manufacturing an unsinkable hull structure according to claim 1, wherein following the injection of said foaming material (3) within the space defined between said bottom hull (1) and said covering (4) and said plurality of longitudinal structural elements (6), a respective plurality of resistant closed cells is made, each of the cells being defined by at least one longitudinal structural element (6) and between said bottom hull (1) and said covering (4).

4. The method for manufacturing an unsinkable hull structure according to claim 1, wherein a high density and low specific gravity foam material is selected for the injection of said foaming material.

5. The method for manufacturing an unsinkable hull structure according to claim 1, wherein said bottom hull (1) and said covering (4) are made by means of lamination of a resinous material.

6. The method for manufacturing an unsinkable hull structure according to claim 5, wherein said resinous material is FRP.

7. An unsinkable hull structure, comprising a bottom hull (1) and a covering (4) of said bottom hull (1);

a plurality of first reinforcing longitudinal structural elements (6) arranged according to the longitudinal direction of said bottom hull (1) and said covering (4) and made integral with the bottom hull (1) by means of the use of structural adhesives and with the covering (4) by means of a plurality of profiled elements (8) each of which is adapted to be arranged in an integral manner on a respective edge of a related longitudinal structural element (6) and by means of the use of structural adhesives filling means (3) for filling the volume defined between said bottom hull (1) and covering (4) and said plurality of first longitudinal structural elements (6);

wherein each profiled element (8) is formed by a profile having a substantially "π" -shaped transversal section, said profile comprising two vertical legs (81) which open swallow-tailed towards their free end and are adapted to cooperate each with the part of free edge of a respective longitudinal reinforcing element (6);

and wherein the minimum free section comprised between the two vertical legs (81) is a few tenths of a millimeter shorter as compared to the thickness of the longitudinal reinforcing elements (6).

8. The unsinkable hull structure according to claim 7, wherein said profile having a substantially "π"-shaped transversal section further comprises:

two side profiles (82) forming a horizontal or tilted plane, complementary to the coupling surface, having a length and a width to form an appropriate adhesion surface by contact with an equivalent lower surface of the covering (4);

a series of holes obtained orthogonally to a horizontal upper plane of said profile (8) each adapted to allow the escape of structural adhesive contained in the above said chamber; and wherein the length of the two vertical legs (81) is to ensure the formation of a chamber between the profiled element (8) and the related part of the edge of the longitudinal element (6), so as to contain an amount of structural adhesive sufficient for the adhesion of the profile (8) of the longitudinal element (6).

9. The unsinkable hull structure according to claim 8, wherein said profiled element (8) is made by means of an aluminum extruded product or fibreglass pultruded product.

10. The unsinkable hull structure according to claim 7, wherein said filling means (3) are formed by a foaming material selected from the high density and low specific gravity foam materials.

11. The unsinkable hull structure according to claim 10, wherein said foam materials are polyurethane foam.

12. The unsinkable hull structure according to claim 7, further comprising a plurality of second longitudinal structural elements (60) adapted to cooperate with said plurality of first longitudinal structural elements (6) to manufacture a stern structure and at the engine-room.

13. The unsinkable hull structure according to claim 12, wherein for a connection of each first longitudinal structural element (6) with a respective second longitudinal structural element (60) there is provided:

at least one first pair of plates (61) adapted to be fixed to a respective end of a first longitudinal element (6);

at least one second pair of plates (61) adapted to be fixed on a respective end of a second longitudinal structural element (6); and screws (62) for the reciprocal fixing of the plates (61) of a first longitudinal element (6) with a respective second longitudinal element (60), the arrangement being such that following the fixing of the screws (62) in the related plates (61) the structural continuity in the longitudinal direction between a first longitudinal element (6) and a respective second longitudinal structural element (60) is obtained.

14. The unsinkable hull structure according to claim 7, further comprising a fixing system of bottom boards for peaks provided in said covering (4) which comprises:

a plurality of tubular profiles (16) arranged at an edge or frame of each peak and gathered therein by lamination; and a plurality of threaded bushes (14) which are firmly mounted on inserts (17) arranged within each tubular profile (16) and at holes (18) provided on said tubular profile (16);

the arrangement being such that each hole (18) corresponds to a threaded seat deriving from a respective underlying bush (14) and for the engagement with a respective fixing element of bottom board.

* * * * *